United States Patent [19]

Strausak

[11] Patent Number: 4,852,211

[45] Date of Patent: Aug. 1, 1989

[54] AUTOMATIC POOL CLEANER

[76] Inventor: Benedikt Strausak, Bergdorf, Switzerland

[21] Appl. No.: 215,297

[22] Filed: Jul. 5, 1988

Related U.S. Application Data

[63] Continuation-in-part of Ser. No. 908,574, Sep. 18, 1986, abandoned.

[51] Int. Cl.[4] ..... E04H 3/20
[52] U.S. Cl. ..... 15/1.7
[58] Field of Search ..... 15/1.7

[56] References Cited

U.S. PATENT DOCUMENTS

| | | | |
|---|---|---|---|
| 3,430,277 | 3/1969 | Ortega | 15/1.7 |
| 3,979,788 | 9/1976 | Strausak | 15/1.7 |
| 4,156,948 | 6/1979 | Chauvier et al. | 15/1.7 |

FOREIGN PATENT DOCUMENTS 648893 4/1985 Switzerland .

*Primary Examiner*—Edward L. Roberts
*Attorney, Agent, or Firm*—Zarley, McKee, Thomte, Voorhees & Sease

[57] ABSTRACT

Two suction disks are rotatingly mounted at the bottom of a housing divided into two filter chambers with a turbine chamber situated between them. A turbine disposed in the latter chamber can be connected by means of a riser and a suction line to a circulating pump. The turbine drives the suction disks in opposite directions of rotation by means of gearing. The turbine chamber communicates with each of the filter chambers through respective openings which can be closed by valve flaps. By means of a driving lever and a shifting bar, one valve flap is alternately opened and the other closed, whereby the suction effect is alternately changed over from one suction disk to the other.

14 Claims, 4 Drawing Sheets

AUTOMATIC POOL CLEANER

This is a continuation-in-part application based upon applicant's co-pending application Ser. No. 908,574, filed Sept. 18, 1986now abandoned.

This invention relates to cleaning equipment, and more particularly to a self-propelling machine for cleaning swimming pools by drawing in the sedimentary material deposited, of the type having a housing, two suction disks, a water turbine which draws its driving power over the suction line of a circulating pump, and a device for switching the suction line over alternately from one suction disk to the other.

BACKGROUND OF THE INVENTION

It is a well-known fact that the main work of cleaning a swimming pool—whether indoor or outdoor—is the removal by suction, or vacuuming, of the sediment which accumulates. Various types of cleaning apparatus have been developed for that purpose, manually operated or fully automatic, and powered by electricity, water pressure, or hydrosuction.

The best cleaning effect is achieved with hydrosuction since all the sedimentary material, some of it slimy, is conveyed through the suction hose directly to the filter installation of the circulating pump, from whence it is carried directly into the sewer system by means of the backwash operation. A machine operating in this manner is disclosed, for example, in U.S. Pat. No. 3,979,788 and, in a modified form, in Swiss Patent No. 648,893. These designs operate perfectly well in swimming pools of any outer shape, provided that the bottom is flat and is not too sharply inclined. For swimming pools of American design, however, which often have gradual transition between the bottom and the walls, as well as diving depressions, the aforementioned apparatus cannot be used. A machine designed for this kind of pool, described in U.S. Pat. No. 4,156,948, can adhere to walls of any steepness by means of a suction disk and is propelled by tapping against the suction disk. This apparatus has only limited possibilities of propulsion and directional control and is continually getting stuck.

It is an object of this invention to provide an improved pool cleaning machine which, regardless of the shape or form of the pool, with floors of any steepness merging into vertical walls, is capable of adhering, moving along, and changing direction without getting stuck at obstacles or climbing above the surface of the water.

To this end, in the machine for cleaning swimming pools according to the present invention of the type initially mentioned, the two suction disks are rotatingly mounted in the housing, and means are provided for driving the suction disks in the direction of rotation.

BRIEF DESCRIPTION OF THE DRAWINGS

Preferred embodiments of the invention will now be described in detail with reference to the accompanying drawings, in which:

FIGS. 2, 5 and 8 show the device in an operative position, while FIGS. 6, 7 and 9 show the device turned upside down in an assembly position, for clarity in showing the components of the device.

DETAILED DESCRIPTION OF THE PREFERRED EMBODIMENT

Figure 1:
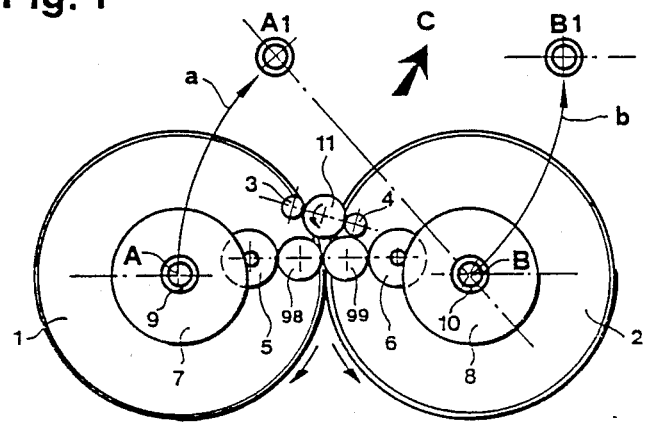
FIG. 1 is a diagrammatic plan view of the suction disks, illustrating the mode of propulsion.
Figure 2:
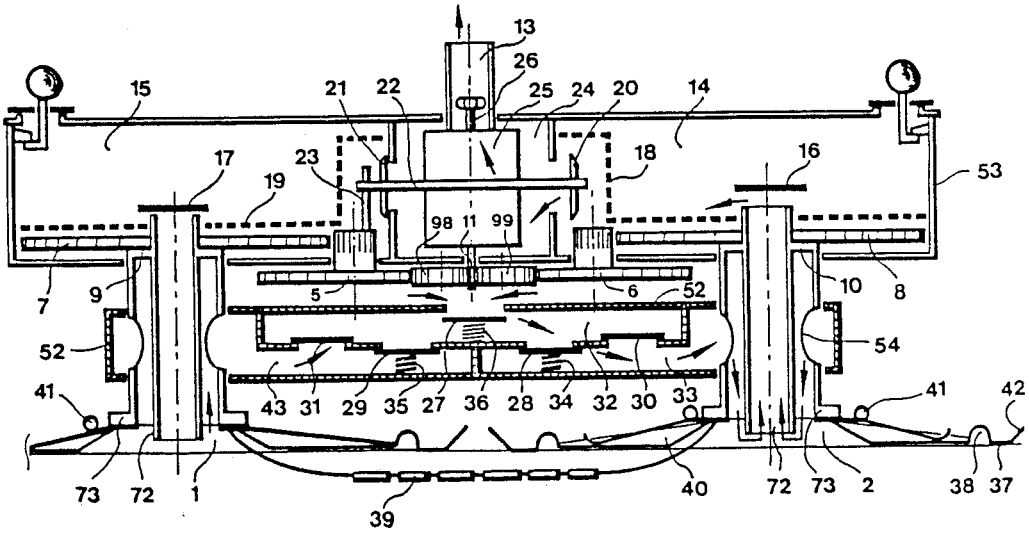
FIG. 2 is a longitudinal section through a machine in one embodiment of the invention, shown in an operating position on the bottom of a pool.
Figure 9:
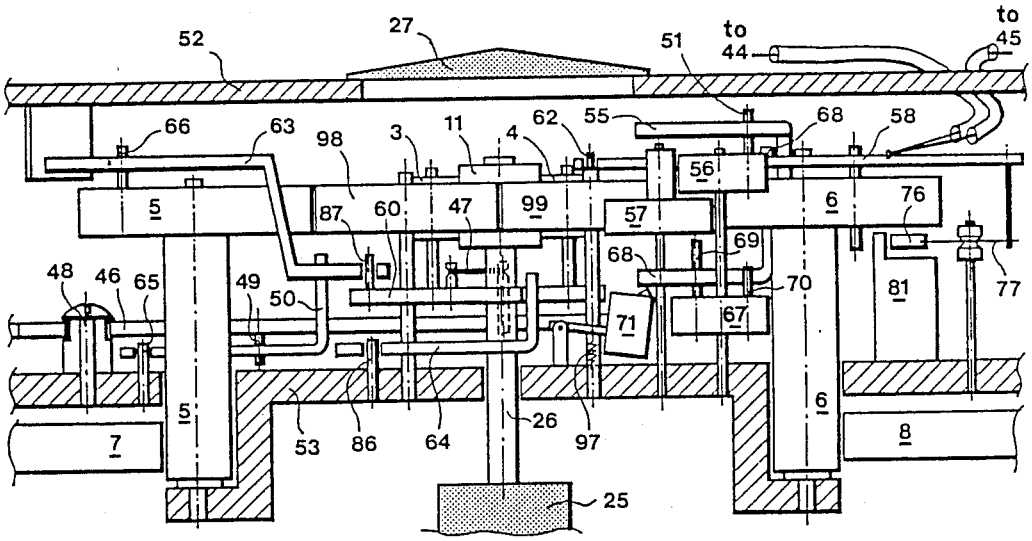
FIG. 9 is a side elevation view of the shifting mechanism, with the unit turned upside down in an assembly stage.

The mode of propulsion of the pool cleaner is illustrated in FIG. 1. Via a shaft-coupled turbine- gear 11 and a control gear 4, a water turbine (not shown in FIG. 1) drives an idler gear 99. and a reduction gear 6 which engages a disk-drive gear 8 and, via a centrally situated suction intake 10 having an axis of rotation B, sets a suction disk 2 in slow, continuous rotation. Analogously, but in the opposite direction of rotation, a suction disk 1 is rotated via gears 3, 98, 5 and 7 and suction intake 9. Gears 5, 6, 7, 8, 98, 99 and 11 are mounted on shafts fastened to an elongated housing 53, as seen in FIGS. 2 and 9. Gears 3 and 4 are mounted on shafts fastened on a pivotal rocker 60, described later. The directions of rotation are indicated by the smaller arrows. Suction disks 1 and 2 of a resilient material, e.g., silicone rubber, rotate in opposite directions and glide over the pool bottom. If water is pulled away from under suction disk 2 through suction intake 10, the disk adheres to the bottom and prevents rotation, resulting in a torque which turns the rest of the machine, including suction disk 1, in the opposite direction about axis B. Axis of rotation A of suction disk 1 moves as indicated by arrow a to location A1. If, at location Al, the suction is transferred from intake 10 to intake 9, axis B moves similarly with suction disk 2 as indicated by arrow b to location B1. If suction is thus applied alternately in a steady rhythm, the result is a step-by-step forward movement in a straight line as indicated by arrow C.

Existing swimming pool filter installations operate with different amounts of water and rates of suction, which are reduced in the machine to acceptable uniform operating values through valve control. With an effective suction disk diameter of 35 cm, for example, a suction pressure of 20 mbar has been found sufficient to obtain a disk contact pressure of about 200 N. The machine can thus unhesitatingly be allowed to work its way up to the surface of the water in a swimming pool lined with plastic film without fear that the film will be pulled away from the wall by suction.

Figure 8:
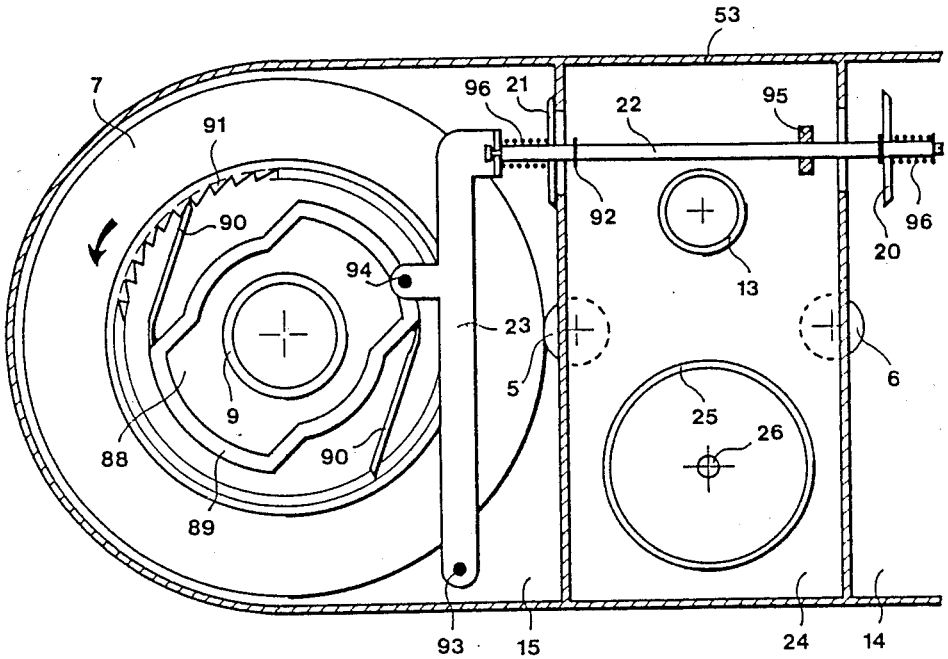
FIG. 8 illustrates the switching mechanism for alternating the rotation of the suction disks.

A possible mode of steering the suction disks will now be explained with reference to FIG. 2. Housing 53 has two filter chambers 14 and 15 with a turbine chamber 24 disposed between them. Suction disks 1 and 2 are rotatingly mounted in the bottom of housing 53. The suction line of the filter installation is connected to the machine by means of a flexible suction hose (not shown) slipped onto a riser 13 which is axially rotatable relative to housing 53. The entire stream of water now flows through the inner pipe of suction intake 10, which is provided with a check valve 16, into filter chamber 14, then through a filter strainer 18 and an open valve flap 20 into turbine chamber 24 and through a water turbine 25 to riser 13. Turbine 25 runs and, via a drive shaft 26 and turbine gear 11, drives idler gears 3, 4, 98, 99 and reduction gears 5 and 6, as well as suction disks 1 and 2, as described above. Disk-driving gear 7, rigidly connected to suction intake 9, additionally controls via an eccentric sheave 89 (shown in FIG. 8), a driving lever 23 which switches valve flaps 20 and 21 over into their opposite positions by means of a switching bar 22, as shown in FIG. 8 and described later. The flow of water analogously passes through intake 9, opened by a check valve 17, and through a filter strainer 19, open valve flap 21, turbine chamber 24, and turbine 25 to riser 13.

If the machine is set on the bottom of a swimming pool, disk 2, for instance, attaches itself to the pool bottom by suction and interrupts the supply of water; the suction force increases to about 5,000 N. This is remedied by installing an equalizing valve arrangement in which the open valve passage should be more than double the inside passage of the suction intake. The water coming from outside flows. in the direction indicated by the arrows in FIG. 2 through an equalizing valve 27 into a valve chamber 32.within a valve box 52, then through an equalizing valve 28 into a valve duct 33 and an opening 54 in the outer pipe 73 of suction intake 10, and thence under disk 2. The water is deflected at a high rate of flow by the pool bottom under intake 10, so that a strong cleansing effect is achieved. The suction force or adhesion to the bottom of suction disk 2 can be adjusted by means of the tension of a spring 34 of equalizing valve 28. Analogously, a spring 35 of equalizing valve 29 is responsible for the forces under suction disk 1.

With valve flaps 20 and 21 in the position shown in FIG. 2, suction disk 1 rotates freely about the firmly attached disk 2 as described above. For cleaning the surface over which disk 1 passes, a partial vacuum is also created under that disk, but it must be much weaker than that under disk 2. The adjustment is made by means of spring 36 of equalizing valve 27. When spring 36 is made stronger, increased intake resistance is opposed to the water freely flowing in from outside, whereby a partial vacuum is created in valve chamber 32 and, when check valve 31 is open, is transmitted through a valve duct 43 to beneath suction disk 1. If disk 1 is not lying tightly against the pool bottom, no partial vacuum can be created. As a result, equalizing valve 27 closes, and the entire suction flow draws the water out from under disk 1, whereby it is immediately applied tightly to the pool bottom again.

Also shown in FIG. 2, rotatingly anchored to the two suction intakes 9 and 10, is a roller chain 39 by means of which a discontinuity is created in the tight application of suction disks 1 and 2 to the pool bottom at one point of each. A localized flow of water is thus produced, by which larger pieces of sediment, such as leaves, are swept under the suction disks. It will be seen (cf. also FIG. 5) that disks 1 and 2 are of identical design and comprise radial water ducts 40 running from the center and opening out into a concentric bulge 38 intended to compensate for irregularities of the pool bottom. Farther toward the outside there is a sealing flange 37 having an upwardly bent rim 42.

Figure 3:
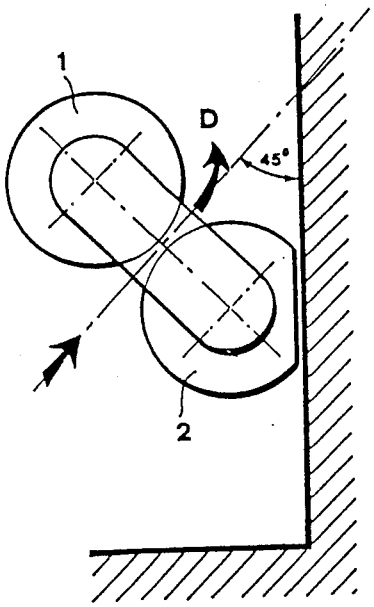
FIG. 3 is a diagram illustrating a deflection maneuver.

As illustrated in FIG. 3, if the machine moves over the pool bottom and, at an angle of, say, 45° , reaches a vertical wall having no rounded transition portion, rim 42 (FIG. 2) with sealing flange 37 is bent upward over bulge 38 so that water can flow in. The adhering suction pressure under disk 2 breaks down and disk 1 ceases to move forward. As the next step, disk 1 attaches itself to the pool bottom by suction and pushes disk 2 even more firmly against the wall. These operations are alternately repeated until disk 2 has pushed past the wall and, the way being cleared, pulls the machine on again in the direction indicated by arrow D in FIG. 3.

Figure 4:
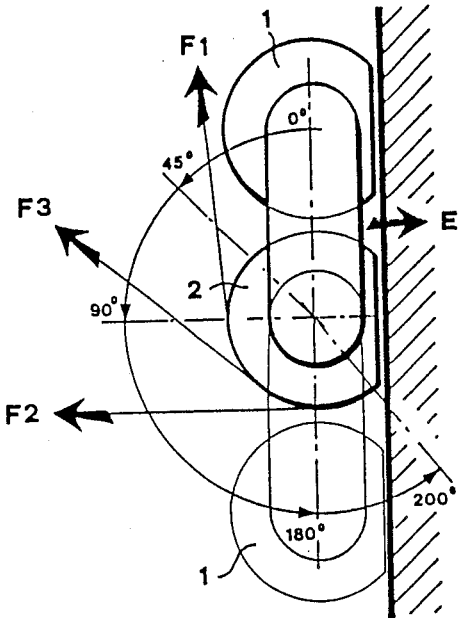
FIG. 4 is a diagram illustrating reversal at a wall.

Turning now to the example illustrated in FIG. 4, if the machine moves directly up to a wall at right angles, in the direction indicated by arrow E, rims 42 of both suction disks 1 and 2 are pushed up, and the disks lose their strong adhesion to the pool bottom, which saves wear and tear on the mechanism. The machine is freed from this position by means of a programmed positive release which is so designed that a shifting device to be explained below, coupled at the outlet side of the turbine, reverses the direction of rotation of all the gears. The machine consequently moves backward. If, however, while the machine is backing up, the mechanism for reversing valve flaps 20 and 21 (FIGS. 2 and 8) is uncoupled by means of a unit operative only in one direction of rotation, which is shown in FIG. 8, valve flaps 20 and 21 remain during the entire backing-up time in the switchover position they had assumed just before the machine shifted into reverse.

In FIG. 4, valve flap 20 for suction disk 2 is assumed to be open. Suction disk 1 rotates about suction disk 2 in the direction indicated by the small arrows. The backing-up time, or rather the angle through which the machine rotates during that time, determines the direction in which the machine will proceed upon shifting back to forward motion. The pre-programmed backing-up times result in alternatingly differing directions for heading away from the wall (F1, F2, F3). With a possible choice of backing-up angles between 0° an 200° , the machine heads toward the wall again if the backing-up angle is from 0°–45 ; is deflected in the direction indicated by arrow D in FIG. 3 if the angle is from 45°–90 ; and is propelled in directions Fl to F3 if it is from 90° to 180° . If the angle is more than 180° , the machine always moves away from the wall at right angles in direction F2. On a later occasion, the foregoing maneuver can take place in the opposite direction by having suction disk 2 rotate about suction disk 1.

If the machine is on an unobstructed path when the sporadic positive release occurs, it changes direction as explained above, again heading on a random path between plus and minus 200° . The machine is steered on an unpredictable zigzag course throughout the swimming pool, thus reaching every corner by the law of probability.

Figure 5:
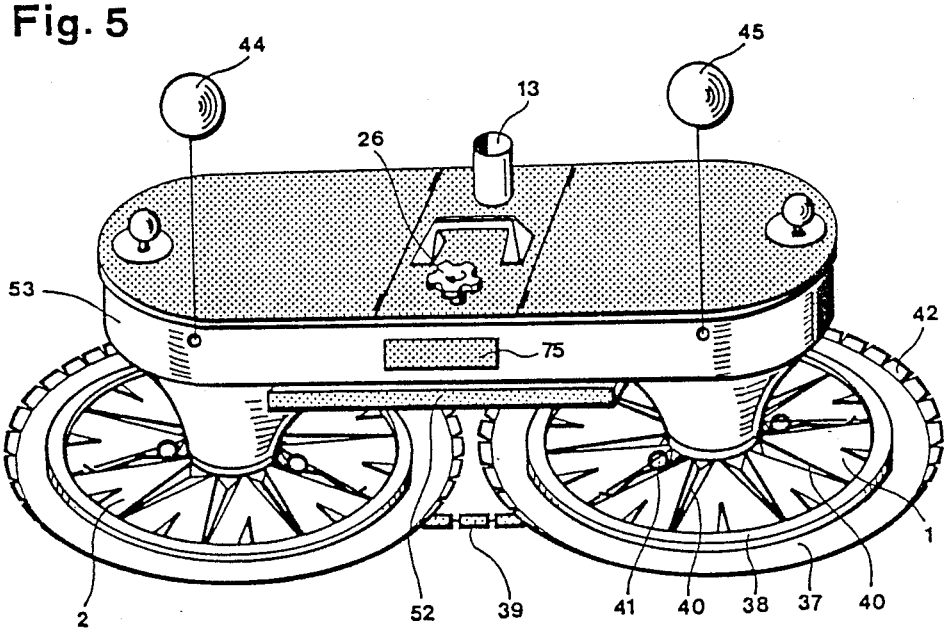
FIG. 5 is an overall perspective view of another embodiment of the invention, shown in an operating position at the bottom of a pool.
Figure 6:
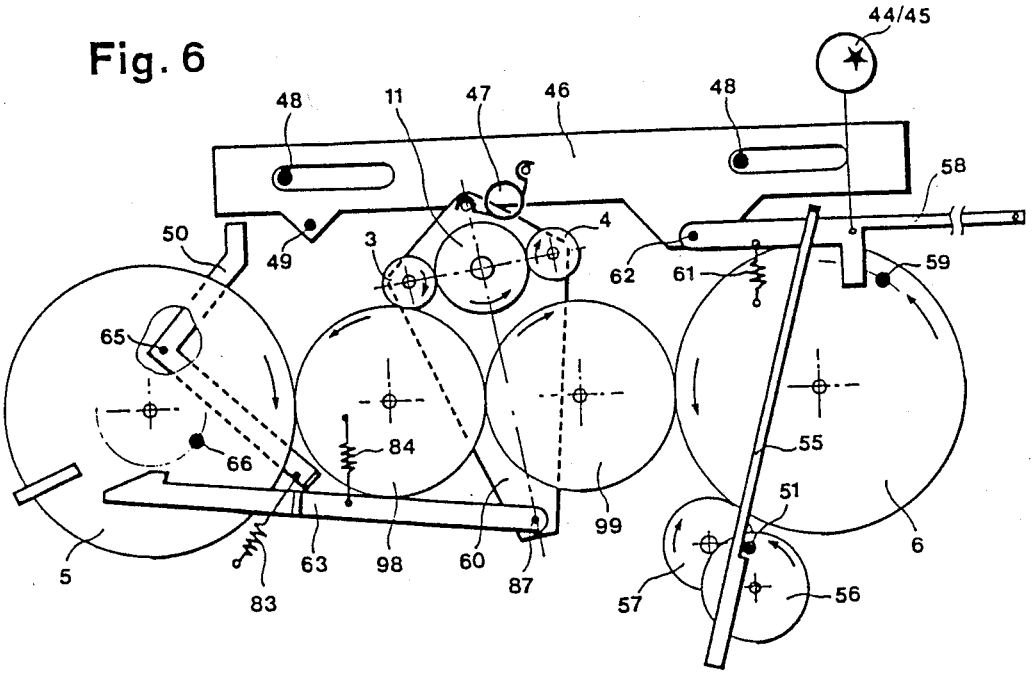
FIG. 6 is a diagrammatic plan view of a shifting mechanism in the forward position, with the unit turned upside down in an assembly stage.
Figure 7:
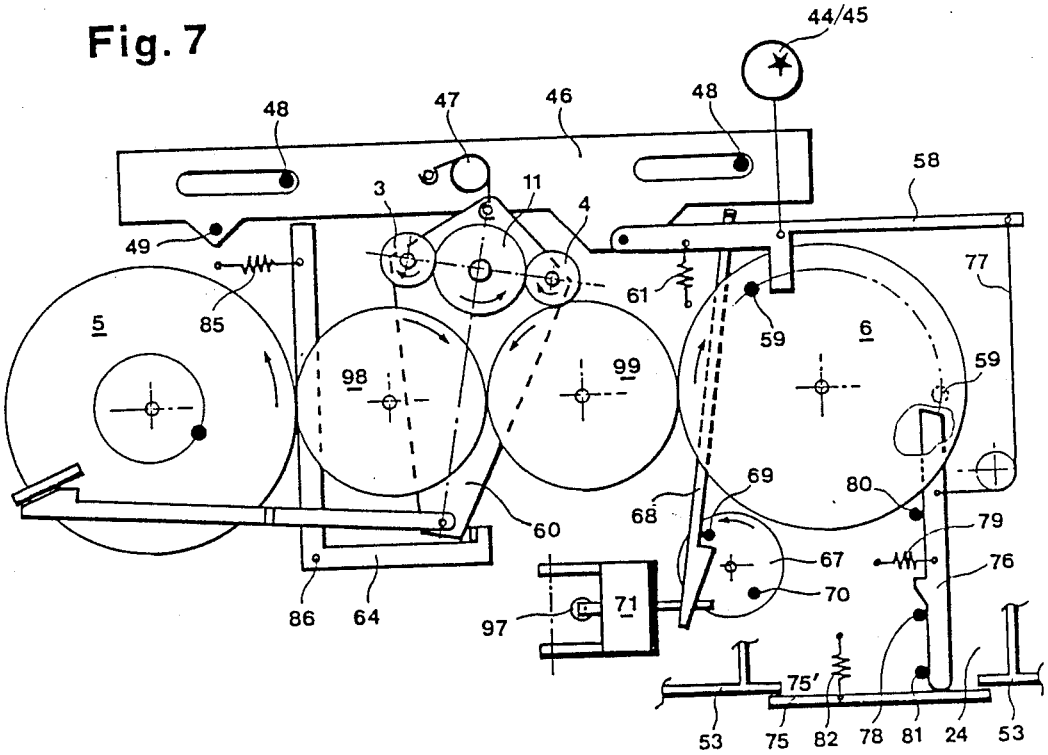
FIG. 7 is a diagrammatic plan view of the shifting mechanism of FIG. 6 in reverse, with the unit turned upside down in an assembly stage.

Shown in FIG. 5 are biased springs 41 which, together with compensating bulges 38, aid the suction disks to remain tightly attached to the surface of any swimming pool having transition radii of about 15 cm or more. As a result, when the machine comes to a wall, it keeps on going over the transition portion and continues climbing. When it reaches the surface of the water, it is shifted into reverse through a buoying body 44 or 45 in a manner to be explained below, whereupon the machine changes direction as described earlier. The latch 58 in, FIGS. 6 and 7 is only schematically connected to the buoying bodies 44 and 45. For instance the connection consists of a flexible filament each, which extends through two connection tubes from the latch to a desired position in FIG. 5. The backing-up angle is limited to a maximum of 100°, however, so that the freely rotating suction disk will not move beyond the surface of the water and suck in air. Since the direction of rotation of water turbine 25 cannot be changed, a shifting mechanism must be interposed for putting the machine in reverse.

A preferred design of such a shifting mechanism will now be described with reference to the diagrams of FIGS. 6, 7 and 9. When the machine is running forward, a slide 46 is urged toward the right by a spreader spring 47 and presses a shifting rocker 60 toward the left, as viewed in FIG. 6, so that control gear 3 engages idler gear 98 and reduction gear 5. Slide 46 is movably screwed onto housing 53 and movement of slide 46 is directed by guides 48. The respective directions of rotation are indicated by arrows. A trip latch 58, pulled upward by one of the buoying bodies 44 or 45, tenses a spring 61. If there is no more buoyancy, or if trip latch 58 is pulled down by a positive release lever 55 via a pin 51 of a cam wheel 56 by means of a reduction gear 57, a driver pin 59 of reduction gear 6 comes up against trip latch 58 and pushes slide 46, connected to latch 58 at a pivot point 62, to the left, as viewed in FIG. 6, until spreader spring 47, together with slide 46 and rocker 60, jumps into the turned-over shift position (cf. FIG. 7).

Owing to the great transmission of force from the water turbine to the suction disk, control gear 3 tends to remain engaged between turbine gear 11 and idler gear 98. Slide 46, having traversed, strikes against a pawl 50 by means of a cam 49 and, via a pivot pin 65, releases a traction lever 63 which catches on a pin 66 of reduction gear 5 and thus disengages control gear 3 against its own retentive force. Pawl 50 is pivotally mounted on pin 65 which is attached to housing 53.

Shifting rocker 60 can then switch over without hindrance into the position shown in FIG. 7, where the situation as regards the transmission of force is just the opposite, control gear 4 tending to disengage itself. This situation is remedied by means of a pawl 64 which prevents rocker 60 from swinging over. The machine runs backward with full force until program gear 67 pulls a reset lever 68 down via pin 69 or 70, whereupon trip latch 58 again engages driver pin 59 of reduction gear 6, now rotating in the opposite direction, and thus pushes latch 58, together with slide 46, to the right, as viewed in FIG. 7. When slide 46 jumps over, its cam 49 strikes against pawl 64 and frees rocker 60 for shifting. Cam 56 and gear 67 are mounted for independent rotation. The gear 67 is responsible for the duration of the machine return travel or a change in direction of the said machine according to FIG. 4. It is driven via a reduction gear (not shown) of gear 6 in such a way, that it rotates once while the suction disks 1 and 2 have turned through approximately 200°. The reset lever 68 is drawn downward and induces the shift of slide 46. Gear 67 then moves clockwise and the pins 69 and 70 displace reset lever 68 only sideways.

Gear 57 is driven via a reduction gear in such a way that, with the turbine running at a moderate speed for example of 5 revolutions per second, it revolves once approximately every 2 minutes and induces a changeover of the direction of motion of the machine. Release ensues via lever 55 at the top.

Pins 69 and 70 of program gear 67 are of different heights, and reset lever 68 can be pushed up by a gravity counterpoise 71; as a result, in a horizontal operating position, only the longer pin 70 triggers resetting, whereby the larger backing-up angle of 200°, for example, as mentioned earlier, is set. If the machine is operating on a wall, however, both pins 69 and 70 can trigger resetting, and the maximum backing-up angle becomes only half as great, i.e., 100°, for example.

At the delineated axial line, FIGS. 7 and 9 (bearing in mind that they are drawn upsidedown), the weight 71 is rotatingly mounted and tenses a spring 97 underneath it. Through the downward tipping motion from the housing 53 in horizontal position, the reset lever 68 is pressed downward and is thus only releasable with the longer pins 69. In vertical operation position, the weight is pulled by the spring 97 against spring opposite the housing and the shorter pins can also trigger reset lever 68.

A cam wheel 88 is rotatingly exposed on the disk-driving gear 7. If the disk-driving gear 7 now turns, driven via reduction gear 5 in the direction of the arrow, a spring shackle 90 from cam wheel 88 catches in an internal gear ring 91 of disk-driving gear 7 and rotates as well. A pin 94 of driving lever 23 now travels along a sunken curve 89 and comes to an inner radius of curve. Here the slide 23 is shifted by pins 93 anticlockwise, whereby the switching bar 22 is drawn to the left and the valve flaps 20 and 21 traversed. The turning continued, this process switches back and the water is sucked alternately from chamber 14 or chamber 15 into the turbine chamber 24. With one circuit the delineated cam wheel 88 produces four switchovers. Naturally, the curves 89 can be set up for six, eight or ten switchovers per wheel rotation.

Springs 96 serve to mechanically compensate the tolerance. A sliding bearing 95 is a component of the housing 53. If the disk-driving gear now rotates during the reverse phase, in the direction opposite to the arrow, spring shackle 90 slides over the teeth of gear ring 91. The cam wheel 88 remains in the momentary position and the switchover process of the valve flaps is interrupted.

Instead of the backing-up angle being limited, turbine chamber 24 may additionally be provided with an aperture 75' closed by a cover 75 (cf. FIGS. 5 and 7). Disposed adjacent to reduction gear 6 is a pressure lever 76 which is longitudinally displaceable and tiltable within bounds. One end of lever 76 rests against the inside of cover 75, which is kept closed by a spring 82 as long as lever 76 does not act upon cover 75. Lever 76 is connected near its other end to trip latch 58 by a traction component 77 and is caused to tilt clockwise, as viewed in FIG. 7, by buoyancy acting upon buoying body 44/45, so that the upper end of pressure lever 76 is disengaged from driver pin 59 of reduction gear 6. If no buoyancy is acting upon body 44/45, lever 76 is tilted counterclockwise by a tension spring 79 and strikes against a pin 80. The top of lever 76 is now situated in the path of driver pin 59. When reduction gear 6 rotates clockwise, driver pin 59 pushes pressure lever 76 downward, thus opening cover 75. In its lowered position, lever 76 is held by a cam which engages behind a stop pin 78. As soon as body 44/45 is again affected by buoyancy, pressure lever 76 is returned to its resting position. Cover 75 is therefore closed again, and the cleaner is propelled as previously described.

Thus, it can be seen that the present invention accomplishes at least all of the stated objectives.

What is claimed is:

1. A self-propelling machine for cleaning swimming pools by suction, of the type having a housing, two suction disks, a water turbine, means for connecting said turbine to the suction line of a circulating pump, and changeover means for causing suction to act upon said two suction disks alternately, wherein the improvement comprises:

means for mounting said suction disks rotatingly in said housing; and drive means for causing said suction disks to rotate.

2. The machine of claim 1, further comprising control gearing interposed between said water turbine and said drive means for switching over the direction of rotation of said suction disks.

3. The machine of claim 1, wherein said housing is elongated and includes a bottom, two filter chambers respectively situated at the ends of said housing, and a turbine chamber situated between said filter chambers, further comprising two pipe assemblies respectively forming the axes of rotation of said suction disks, each of said pipe assemblies including an inner pipe concentrically disposed within an outer pipe, one pipe of each of said pipe assemblies being mounted rotatingly and axially immovably in the bottom of said housing, and each said inner pipe opening out at one end into one of said filter chambers and at the other end into one of said suction disks.

4. The machine of claim 1, further comprising a valve box and a plurality of pressure-equalizing and regulating valves disposed in said valve box, said suction disks communicating via said valves.

5. The machine of claim 4, wherein said valve box is disposed beneath said housing, a portion of each said outer pipe being enclosed within an end region of said valve box and including an aperture for enabling communication between said suction disks.

6. The machine of claim 1, further comprising a plurality of spring elements for biasing said suction disks, wherein said suction disks are of a resilient material and each include a suction side, an outer margin, a plurality of radial water ducts disposed on said suction side, a bulge formed in said outer margin, said water ducts opening out into said bulge, and a sealing flange adjacent to said bulge and having an upwardly bent rim.

7. The machine of claim 1, wherein said changeover means comprises a switching component, two valve flaps connected by said switching component, and means for opening either of said valve flaps only while the other is closed, further comprising a driving lever for actuating said switching component.

8. The machine of claim 7, further comprising a coupling operatively connecting said driving lever to one of said suction disks, said coupling being dependent upon the direction of rotation of said one of said suction disks.

9. The machine of claim 7, further comprising a disturbance gear for delaying the action of said changeover means, said disturbance gear operatively connecting said driving lever to one of said suction disks.

10. The machine of claim 11, further comprising reversing means for reversing the direction of rotation of said suction disks.

11. The machine of claim 10, wherein said turbine comprises a drive shaft, and said reversing means comprise a shifting rocker pivotable about said drive shaft, two control gears mounted on said shifting rocker, a slide, and a spreader spring connecting said slide to said shifting rocker, further comprising two driving gears respectively associated with said two suction disks, a trip latch pivoted on said slide, and a driver pin disposed on each of said driving gears for actuating said slide via said trip latch.

12. The machine of claim 11, further comprising a first pawl for holding said shifting rocker in a first end position, a traction lever and a second pawl for releasing said shifting rocker from a second end position, and a cam disposed on said slide for actuating said first and second pawls alternately.

13. The machine of claim 11, wherein said housing includes an aperture, further comprising at least one buoying body, a traction means connecting said body to said trip latch, a displaceable positive-release lever and a displaceable reset lever form-lockingly connected to said trip latch, a cover for closing and opening said aperture, and means for opening said cover when said buoying body is unaffected by buoyancy.

14. The machine of claim 1, further comprising spacer means for interrupting the sealing effect of said sealing flange on said suction side of each of said suction disks.

* * * * *